United States Patent [19]

Spengler

[11] Patent Number: 4,676,190

[45] Date of Patent: Jun. 30, 1987

[54] DEFLECTING DEVICE FOR VISCOUS COATING MATERIAL FREELY FLOWING IN THE FORM OF A SHEET

[76] Inventor: Walter Spengler, Strehlgasse 23, CH-4105 Biel-Benken, Switzerland

[21] Appl. No.: 835,556

[22] Filed: Mar. 3, 1986

[30] Foreign Application Priority Data

Mar. 14, 1985 [CH] Switzerland ..... 1152/85

[51] Int. Cl.[4] ..... B05B 5/02

[52] U.S. Cl. ..... 118/636; 118/DIG. 4

[58] Field of Search ..... 118/621, 624, 625, 324, 118/DIG. 4, 636; 427/420

[56] References Cited

U.S. PATENT DOCUMENTS

| | | | |
|---|---|---|---|
| 705,691 | 7/1902 | Morton | 118/636 X |
| 2,963,002 | 12/1960 | Glaus | 118/324 |
| 3,468,691 | 9/1969 | Watkins | 118/636 X |
| 4,128,667 | 12/1978 | Timson | 427/420 X |

*Primary Examiner*—Evan K. Lawrence

*Attorney, Agent, or Firm*—Bell, Seltzer, Park & Gibson

[57] ABSTRACT

A deflecting device includes a deflecting electrode (13), which is disposed at a spacing below a lip nozzle (11.1), from which the viscous coating material (10.2, 10.1) flowing freely in the form of a sheet is emerging, and which extends over the entire width of the coating material sheet. This deflecting electrode includes an electrode arrangement (31), the exposure region of which facing the sheet surface is subdivided into a number of electrode elements (33) which taper outwardly to a point. When placed under a voltage, the electrode arrangement (31) provides an ion stream directed towards the surface of the coating material sheet. The impact of this ion stream on the surface of the coating material sheet (10.2) imparts to the latter a change in direction ($\alpha$) towards the deflecting electrode (13), so that a flat substrate (5.1) running horizontally towards the deflected coating material sheet (10.1) impinges on the sheet (10.1) at an acute angle ($\beta$). The impact of the substrate (5.1) on the sheet (10.1) at an acute angle causes a smooth, undulation-free application of the coating material to the substrate surface.

10 Claims, 7 Drawing Figures

Figure 1:
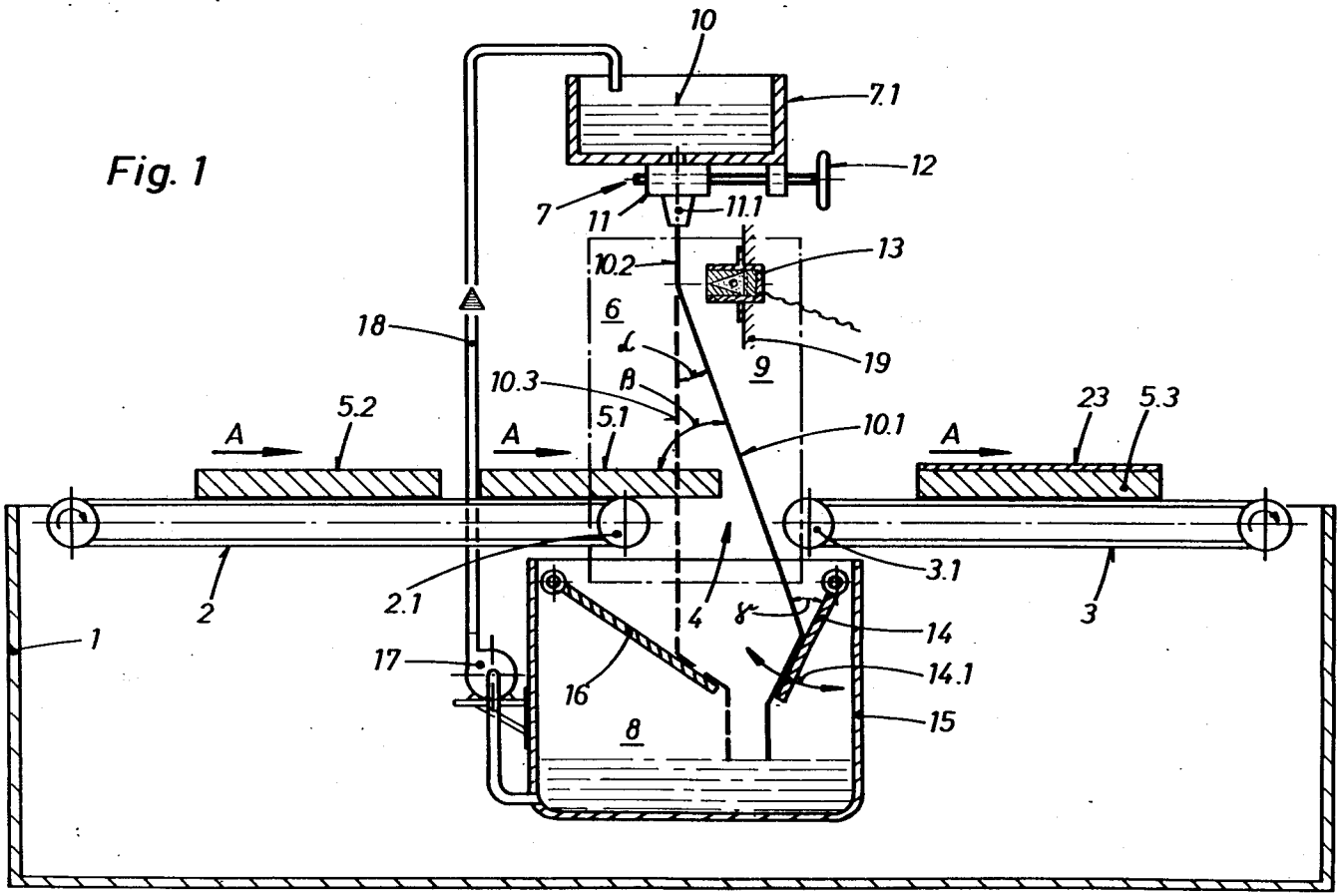

Fig. 2
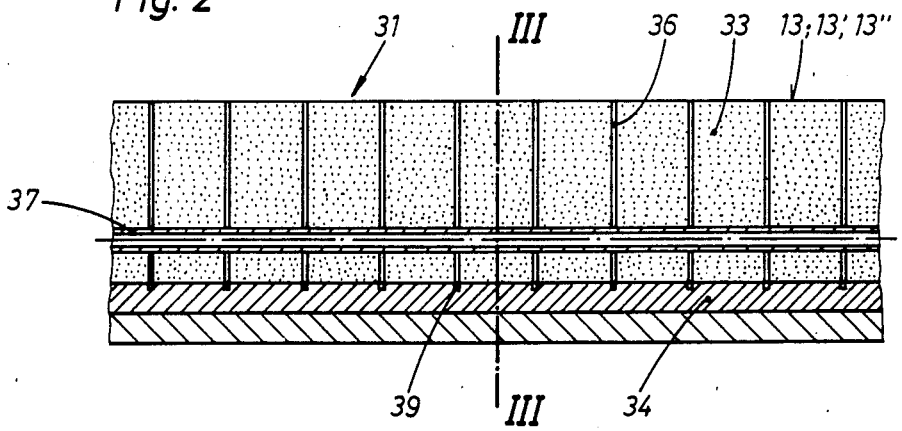
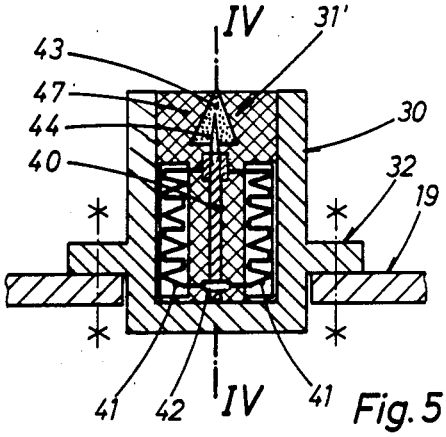
Fig. 5
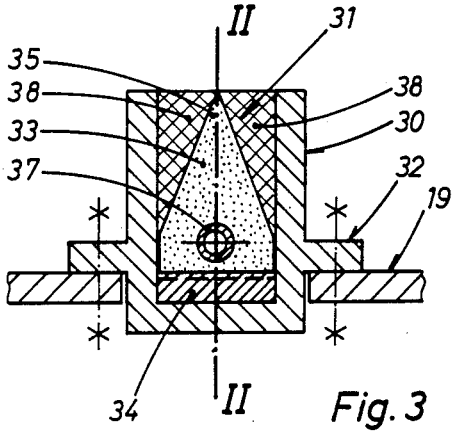
Fig. 3
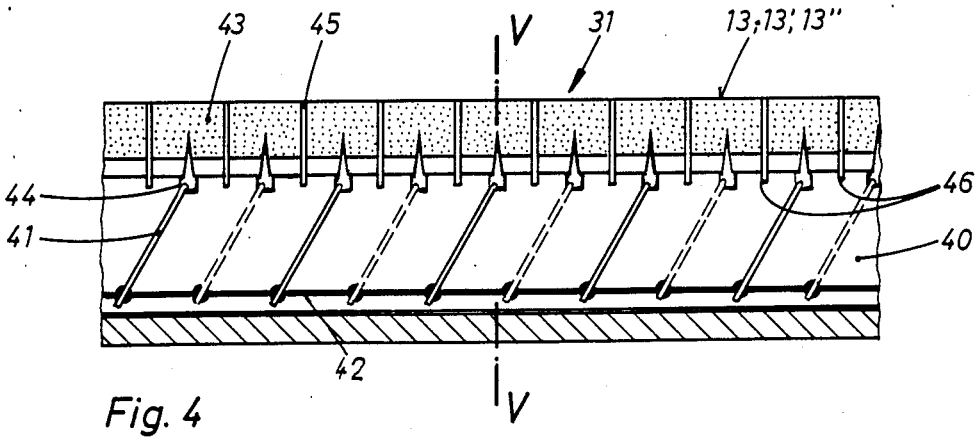
Fig. 4

DEFLECTING DEVICE FOR VISCOUS COATING MATERIAL FREELY FLOWING IN THE FORM OF A SHEET

The present invention relates to a deflecting device for viscous coating material freely flowing in the form of a sheet.

It is known to employ a so-called lacquer casting machine for the application of liquid (viscous) coating material to flat, horizontal surfaces of a substrate. The principal area of application of such machines is the coating of flat plates of wood, metal, plastic material etc., which are designed in formats with practically any, but preferably rectangular outline shapes. The problem giving rise to the invention is to be set forth with reference to plate-shaped substrate bodies, hereinafter simply referred to as plates.

The plates are fed on a horizontal transport web, e.g. a conveyor belt, to a processing station, at which they are moved past under a casting head emitting the viscous coating material in the form of a liquid sheet of calibrated thickness. Such a machine is designed for continuous operation, the liquid sheet flowing without interruption practically vertically downwards in the direction of a collecting container, in which coating material not used for a coating process is collected and returned to the casting head by means of a pump. A spacing is preferably maintained between two successive plates, so that the coating can commence precisely at the leading edge and terminate at the trailing edge, and no bridges of coating material are formed between adjacent plates.

Since the plates having a thickness of preferably 10–40 mm are provided with leading and trailing surfaces standing perpendicular to the plate surface and pass through at a speed of approximately 50 m/min under the casting head, there is a danger that the coating material sheet, which has a thickness of approximately 3/100 mm to approximately 6/100 mm and which likewise falls substantially vertically, will start to oscillate or flutter as a result of the pressure of the air which has built up at the plate on the inlet side and the vacuum on the outlet side. As a result of the instability on the inlet side, which is predominantly due to the air pressure head, there is produced at the coating material sheet a wave-like cross-sectional shape, which results in surface irregularities in the coating in the inlet region of the plate. Since a smoothing operation at the still liquid coating material is as good as ruled out, costly further processing must be provided for in order to achieve a clean edge region. The vacuum on the outlet side does indeed have no disadvantageous consequences as regards the appearance of the coating; however, it increases the difficulty of separating the sheet at the end of the coated plate and promotes the formation of a standing wave at the coating material sheet, which now stands opposite the following plate.

Experiments have shown that the corrugation of the coating material sheet on the inlet side of the plate to be coated can be caused virtually to disappear if an acute angle is maintained between the plate surface and the sheet surface in the directions of movement of the plate and of the sheet. It is assumed that as a result of this measure the build-up of an air pressure zone at the plate inlet side is prevented, since the air forming a pressure head can freely flow away in a downward direction from the wedge-shaped space formed in front of the plate inlet side. The initial contact of the flattened-out sheet surface with the plate surface thus takes place "softly". The subsequent coating of the plate surface by the coating material sheet, which is already inclined in the direction of movement of the plate, can take place without a large change of direction in the sheet material.

On reaching the trailing edge of the plate, the suction effect acts at the reverse side of the plate in such a manner that the sheet is drawn by suction to the plate edge and, as the plate continues to move, is directly pulled off below the edge. It is to be assumed that as a result of the separation of the sheet below the plate edge, the progress of the sheet remains stable and the leading edge of the subsequent plate runs on to a flat sheet surface.

However, the problem consists in deflecting a coating material sheet in a selfsupporting manner at an acute angle to a flat substrate surface, while maintaining horizontal delivery of the substrates to be coated or of the said plates on a transport arrangement. In this connection, it must be borne in mind that on the one hand the use of a horizontally running transport arrangement offers substantial operational advantages as compared with such an arrangement with rising and/or falling sections of movement, and that on the other hand, however, a liquid sheet flowing down from a casting head can only flow away vertically on a natural path, for physical reasons. A possibility for the non-contact deflection of a liquid sheet which has a thickness of only 3–6 hundredths of a millimeter consists in directing air currents towards the sheet surface below the casting head in such a manner that the sheet alters its direction of motion in the desired manner. Quite apart from the fact that it is extremely difficult to generate sufficiently stable surface currents, which ensure the guiding of the sheet in a flat configuration, such air curtains have the tendency to alter the liquid surface, e.g. to oxidize it and/or to dry it out. A disadvantage would in particular be a reduced adhesion capacity on the substrate body or the plate surfaces.

The object of the invention accordingly consists in proposing a deflecting device for viscous coating material flowing freely in the form of a sheet, with which device the abovementioned problem can be reliably solved in a simple manner.

Figure 1B:
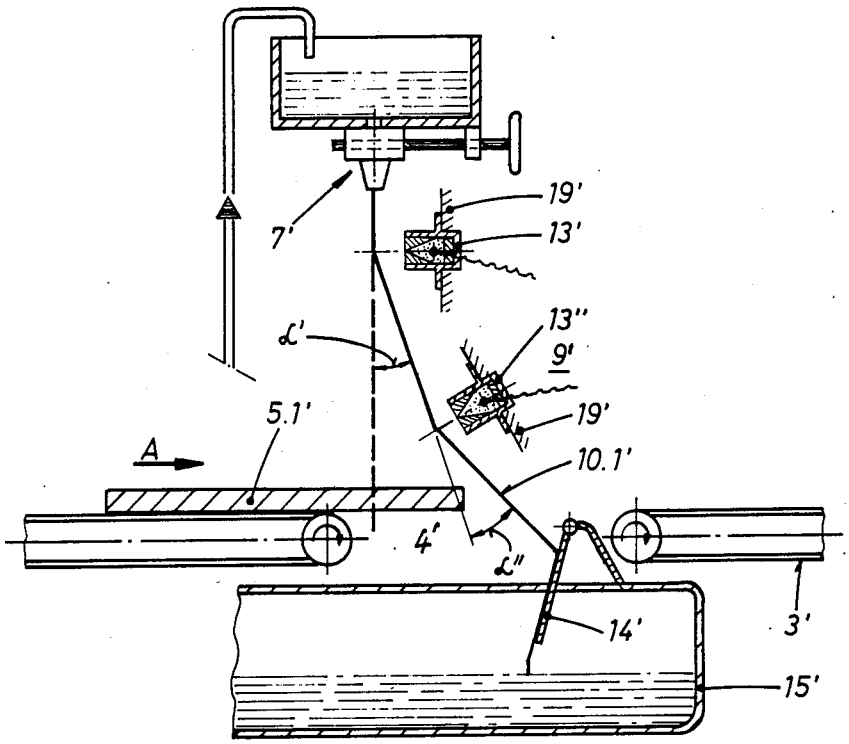
Figure 1A:
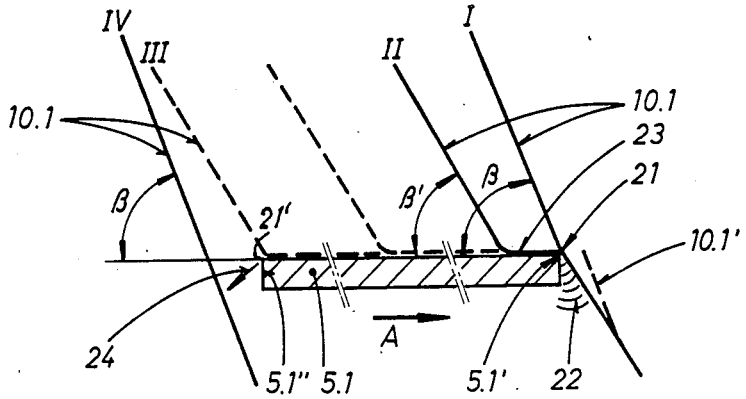

The invention is explained hereinbelow by way of example, with reference to the drawing. In the drawing:

FIG. 1 shows schematically, in side elevation, a conventional lacquer casting machine provided with a deflecting device, according to the invention, for freely flowing coating material, FIG. 1*a* shows schematically the initiation and draw-off process in the application of the coating to a substrate, FIG. 1*b* shows a modified embodiment of the deflecting device according to FIG. 1, FIG. 2 shows a first embodiment of an electrode arrangement which can be used in the deflecting device, for the generation of an ion stream directed towards the "external surface" of the coating material sheet, in partial longitudinal section (II—II in FIG. 3), FIG. 3 shows the electrode arrangement according to FIG. 2 in section along the line III—III, FIG. 4 shows a second embodiment of the electrode arrangement, similar to FIG. 2, likwise in partial longitudinal section (IV—IV FIG. 5), and FIG. 5 shows the electrode arrangement according to FIG. 4, in section along the line V—V.

The lacquer casting machine shown schematically in FIG. 1 includes, within a machine frame 1, a delivery-side (first) conveyor arrangement 2, and an exit-side (second) conveyor arrangement 3, which are separated from one another by a so-called casting gap 4, which will be explained later. The conveyor arrangements 2 and 3 are preferably longitudinally arranged, synchronously running transport belts, which ensure stable guiding of the substrates 5.1, 5.2 and 5.3 to be coated through the machine. The minimum width of the casting gap 4 is given both by the length of the substrates 5.1, 5.2 etc. and also by the design and the mode of operation of a coating arrangement designed generally by 6, and can be designed to be narrower or wider by a decrease or an increase in the relative spacing of the conveyor arrangements 2, 3.

The coating arrangement 6 consists essentially of a schematically shown casting head 7, a deflecting device 9, according to the invention, for a coating material sheet 10.1, and a collecting arrangement 8 for coating material not applied to substrates 5.1, 5.2 etc. The casting head 7 of a known embodiment comprises essentially a storage container 7.1 to receive liquid single-component or multi-component coating starting material 10 with a high dielectric constant and a longitudinal flat nozzle 11 at the floor of the storage container 7.1. The longitudinal dimension of its casting lips 11.1 is coordinated with the coating width at the substrates 5.1, 5.2 etc., and its width of transmission can be set by means of a calibration device 12 to the desired thickness of the coating material sheet 10.1. This thickness is usually within the range from 0.02 to 0.08 mm. The speed at which the sheet flows out from the flat nozzle 11 and the surface stability depend essentially upon the viscosity of the coating starting material. The prerequisite is a closed-surface, uniform and flat flow emerging from the flat nozzle 11, with theformation of a sheet section 10.2 flowing in the first instance vertically downwardly along a path of travel.

By means of a deflecting electrode 13 which will be described later, there can be imparted to the coating material sheet 10.1 by an ion stream emerging from the deflecting electrode 13 a deflecting effect, as a result of which the sheet 10.1 experiences a path inclination $\alpha$ towards the electrode 13 from the ion impact zone on its surface onwards. This path inclination can be adjusted by application to the electrode 13 of a voltage adapted to the desired angle of inclination. Expediently, the path inclination $\alpha$ is selected in such a manner that the coating material sheet 10.1 does indeed pass as close as possible to the inner deflecting region 3.1 of the exit-side (second) conveyor arrangement 3, but is not drawn onto the latter. Such a danger exists in consequence of the ionization of the surface of the sheet 10.1 on the electrode side. When, as shown, no substrate (e.g. 5.1) bridges the casting gap 4, the sheet 10.1 passes in an oblique position through the gap 4 towards a first collecting flap 14, the inclination angle $\alpha$ of which can be adjusted (double arrow 14.1). In this connection, it is important that the sheet 10.1 impinges on the flap 14 in such a manner that the coating material flowing forward can flow away from the flap surface into a collecting trough 15 without any tendency to building up a pressure head. As a result of this, the creation of undulating and fluttering of movements at the lower end of the sheet 10.1 can effectively be counteracted.

When the deflecting electrode 13 is switched off, the coating material sheet 10.3 flows according to the broken line in a vertical direction directly in front of the inner deflecting region 2.1 of the delivery-side (first) conveyor arrangement 2 to a second collecting flap 16 in the collecting trough 15. Just like the first collecting flap 14, this flap is also expediently inclined in such a manner that the coating material sheet 10.3 freely flowing down flows away from the flap surface into the collecting trough 15 without any tendency to build up a pressure head. A return pump 17 returns the coating material which has collected in the collecting trough 15 to the trough 7.1 of the casting head 7 at appropriate time intervals via a pipe 18.

When the lacquer casting machine according to FIG. 1 is set into operation, in the first instance the coating material sheet (partial sections 10.2, 10.3) is brought out of the casting head 7 by setting of the flat nozzle 11 to the desired thickness of 0.03 to 0.06 mm and uniform outflow. At this stage, the sheet runs in a substantially vertically downward direction (broken line 10.3). Following this, the deflecting electrode 13 is aligned by adjustment of its supporting device 19 and is acted upon, by application of a high voltage, by a potential which is capable of causing a deflection of the sheet section 10.1 below the electrode 13 through an acute angle $\alpha$. When the delivery-side and exit-side conveyor arrangements 2 and 3 have been set into operation, in the first instance a first substrate, in FIG. 1 the plate 5.1, is guided into the casting gap 4 and conducted at a speed of 40–60 m/min in the direction of the arrow A through the casting gap 4, so that the surface of the plate 5.1 is covered with a coating of coating material.

The coating process which results in this connection is schematically represented in FIG. 1*a*, in its individual Phases I to IV. As soon as the leading edge 5.1′ runs up to the sheet 10.1 approaching at the angle $\beta=90°-\alpha$ (Phase I), the latter breaks away along this edge. The edge 5.1′ is expediently of a sharp configuration, in order to achieve a defined line of breakage 21. As a result of the air pressure head 22 prevailing below the line of breakage 21, the sheet section 10.1′, which is downwardly oriented and which falls rapidly in a downward direction, is pressed to some extent at its upper end away from the end surface of the plate 5.1 (broken lines), so that coating of the end surface and thus undesired further processing are avoided.

The speed of forward movement of the plate 5.1 and the rate of flow of the coating material sheet must be coordinated with one another in such a manner that the sheet is slightly stretched when applied to the plate surface, in order to achieve a clean coating 23. The result of this is that the initial angle of approach $\beta$ decreases slightly to $\beta'$ in the course of the coating operation (Phase II), i.e. the sheet 10.1 runs ahead in a somewhat flatter configuration in the course of coating. This condition persists until the plate trailing edge 21′ is reached (Phase III). At this point, supported by a trailing edge vacuum, the sheet 10.1 breaks off and, in consequence of the now free access of air, returns again according to arrow 24 to its original inclination $\beta$ (Phase IV), without coating the plate trailing side 5.1″. In this connection, cf. also the plate 5.3 in FIG. 1 on the conveyor arrangement 3.

In the event that the coating material sheet 10.1 cannot be sufficiently deflected by a single deflecting electrode 13, a deflecting arrangement 9′ with two (or more) deflecting electrodes 13′, 13″ can be used according to FIG. 1*b*. The reference numerals provided with a superscript designate components which are identical with those evident from FIG. 1. In principle, the casting head 7′ can be constructed in the same manner as that according to FIG. 1. In the same way, the two deflecting electrodes 13′, 13″ can be designed in the same manner or indeed in a different manner. The web inclination changes $\alpha'$ and $\alpha''$ caused by the two deflecting electrodes 13′, 13″ are adjusted in a manner similar to the procedure described with reference to FIG. 1. The two deflecting electrodes 13′, 13″ are constructed on supporting devices 19′, the positions of which can be changed and which, in association with an adaptation of the electrode potentials, permit adjustment of the desired change in path inclination in sections. On flowing out in spaces between substrates, as is also shown with reference to FIG. 1, the coating material sheet 10.1′ impinges again on the collecting flap 14′ at an acute angle, in order to avoid backwash while flowing out.

Two examples of the construction of the deflecting electrode 13 or 13′, 13″ are evident from FIGS. 2 to 5. In both embodiments, an electrode arrangement generally designated by 31 or 31′ is situated within the cavity of an elongate, essentially U-shaped profiled insulating housing 30. The insulating housing 30 is expediently provided with flange elements 32 for the securing of the deflecting electrode on a schematically represented supporting device 19.

The electrode arrangement of the embodiment according to FIGS. 2 and 3 consists essentially of a series of approximately prismatic electrode bodies 33 constructed of a material having a high electrical resistance (order of magnitude 50 MΩ. cm). The electrode bodies 33 have the cross-sectional shape of an approximately isosceles, slender triangle, the base of which rests on a height-compensating and spacing piece 34, and the vertex of which is approximately flush at the height of the top of the housing. The vertex regions 35 of all electrode bodies 33 are disposed, in the longitudinal direction of the deflecting electrode 13, on a straight line which extends substantially parallel to the longitudinal axis of the housing. The electrode bodies 33, which have a width of 1 to 2 cm (seen in the longitudinal direction of the electrodes) are separated from one another by insulating spacers 36 having a thickness of 1.5 to 3 mm, and, according to FIG. 2, are connected in parallel with one another or fed by a continuous conductor rod 37. By the subdivision of the entire length of the electrode into a relatively large number of discrete lengths corresponding to the electrode bodies 33, it is intended on the one hand that it should be ensured that a charge field distribution as uniform as possible is present along the electrode 13. On the other hand, it is intended that the contact current intensity should be kept at a low level by the resulting distribution of the overall cross-section of the electrode body, in order to prevent the generation of sparks between components of mutually opposite polarity.

The insulating spacers 36 have a thickness of 1.5 to 3 mm and consist of an inherently stable material, which is capable of forming an integral body in conjunction with a cast resin filling the free spaces 38 in the housing 30. The insulating spacers 36 are expediently centered with spacing, at least in the height-compensating piece 34, in grooves 39, in order to achieve a unitary construction of the electrode arrangement 31.

In the embodiment according to FIGS. 4 and 5, an insulating housing 30 is again employed, which is attached to a supporting device 19 by means of flange means 32. An electrode arrangement 31′ is incorporated in the cavity of the housing. This arrangement consists essentially of a central, longitudinally extending insulating material supporting wall 40, individual resistors 41 which have high resistance and which are disposed on both sides thereof and which are fed in parallel, and a series of prismatic electrode bodies 43, which are approximately triangular in cross-section and which are constructed of a material with preferably a high electrical resistance. The latter are fitted in each instance on a respective pointed contact element 44, so that they form an electrical connection with the outer end of the associated individual resistor 41. The individual resistors 41, which have resistance values of 50 to 100 MΩ, are connected at a lateral spacing from the supporting wall 40 with the common feeding rail 42 and the contact elements 44 in such a manner that they are situated alternately on the two sides of the supporting wall 40. Their outer limiting regions are spaced from one another to such an extent that these regions at the same time center the supporting wall 40 and the triangle vertices of the electrode bodies 43 within the insulating housing 30 on the central longitudinal plane of the electrodes. The triangle vertices of the electrode bodies 43 are, in turn, situated approximately at the height of the top of the housing.

The electrode bodies 43 have a width of approximately 10–20 mm (seen in the longitudinal direction of the electrodes) and are separated from one another by insulating spacers 45. In order to achieve uniform spacing, the latter can be inserted into grooves 46 on the top of the supporting wall 40. As has already been described with reference to FIG. 2 and FIG. 3, this results once again in an optimally uniform charge field distribution along the electrode 13. As a result of the individual feeding of the electrode bodies 43 via the resistors 41 of high resistance, it is furthermore possible also to maintain the contact current intensity at a low level and thus to eliminate the danger of the formation of sparks between components of mutually opposite polarity.

The insulating spacers 45 can be constructed of the same material as the insulating spacers 36 of FIG. 2, and the free spaces remaining in the cavity of the housing between the housing walls and the components of the electrode arrangement 31′ are filled by a cast resin 47.

By means of the deflecting electrode 13 divided into discrete longitudinal sections in the described manner, it is possible to achieve an optimally uniform field distribution along the length of the deflecting electrode 13. Any differing field strength levels between adjacent electrode sections which may result from inhomogeneities in the individual electrode bodies 33, 43 and/or unequal resistance values due to tolerances among the individual resistors 41 of high resistance are locally limited. Differences in levels arising from unequal surface charge at the electrode due to dirt, dust and/or moisture are within operationally permissible limits. In cases of application in which field strength levels which are graduated along the length of the electrode are necessary or expedient, provision can readily be made for an electrical separation of the feed conductors of individual or groups of electrode bodies 33, 43 from adjacent regions.

The above described deflecting device for viscous coating material flowing freely in the form of a sheet may be employed in all cases where the coating material is to be brought, without contact, from a first (original)

direction of flow into a second (deflected) direction of flow. As a result of the possibility of operating the deflecting electrodes with very low local contact current intensities, the deflecting device according to the invention can also be used, without danger, in the processing of coating materials with readily flammable solvents.

What is claimed is:

1. A deflecting device for viscous dielctric coating material flowing freely downwards in the form of a sheet from a storage container via a lip nozzle along a vertical path in the direction of a coating region situated vertically thereunder, said deflecting device comprising at least one deflecting electrode disposed below and spaced from the lip nozzle and spaced from said path and extending over at least the entire width of said path of the coating material sheet, said deflecting electrode including an electrode arrangement, facing said path and which includes a number of electrode bodies outwardly tapering to a point and which, when placed under voltage, provide an ion stream flowing towards said path for impacting the surface of the coating material sheet to impart to the sheet a change in direction towards the deflecting electrode; and a collecting flap, which is disposed below the coating region in a collecting trough, for collecting coating material not employed for coating and which flap extends at least over the entire width of the path, for the backwash-free introduction of the coating material sheet deflected by the deflecting electrode into the collecting trough.

2. The deflecting device as claimed in claim 1, wherein the said collecting flap is pivotably disposed, in order to optimize the inclination angle between the sheet and flap for the stabilization of the coating material sheet.

3. The deflecting device as claimed in claim 1, wherein the collecting trough contains a further collecting flap for the backwash-free introduction of an undeviated coated material sheet into the collecting trough.

4. The deflecting device as claimed in claim 1, wherein the electrode arrangement of the deflecting electrode is accommodated within a channel-shaped, elongated insulating housing and is integrally cast in the latter, wherein the electrode arrangement is provided with a series of a plurality of substantially prismatic electrode bodies constructed of a weakly conducting material, which are spatially separated from one another by insulating separators, wherein the electrode bodies are provided with a longitudinally oriented sharpened region facing the channel opening of the insulating housing, and wherein all sharpened regions are disposed to be aligned in relation to one another on a substantially straight line parallel to the longitudinal axis.

5. The deflecting device as claimed in claim 1 wherein all electrode bodies or groups thereof are directly connected with a conductor rod which is common or continuous in sections.

6. The deflecting device as claimed in claim 1 wherein the electrode bodies consist of a material having a resistance of the order of magnitude of 50 MΩcm.

7. The deflecting device as claimed in claim 6, wherein the electrode bodies have a width of 1 to 2 cm in the longitudinal direction of the electrodes, and the insulating separators disposed between adjacent electrode bodies have a thickness of 1.5 to 3 mm.

8. The deflecting device as claimed in claim 1 wherein all electrode bodies or groups thereof are connected via an individual resistor of high resistance directly with a feeder rail, which is common or continuous in sections.

9. The deflecting device as claimed in claim 8, wherein the individual resistors have values within the range of 50 to 100 MΩ.

10. The deflecting device as claimed in claim 8, wherein the electrode arrangement of the deflecting electrode has a central supporting wall which is constructed of insulating material and to which the individual resistors are attached between a feeder rail and a contact element disposed at the top, and wherein the electrode body is fitted, so as to be connected in electrical contact, on the associated contact element.

* * * * *